United States Patent [19]

Tjännberg

[11] 4,228,202

[45] Oct. 14, 1980

[54] METHOD FOR MAKING A CELLULOSIC MATERIAL FIRE-RESISTANT

[76] Inventor: Bo O. E. Tjännberg, Box 5140, 421 05 Västra Frölunda, Sweden

[21] Appl. No.: 44,999

[22] Filed: Jun. 4, 1979

[30] Foreign Application Priority Data

Jun. 16, 1978 [AT] Austria ..... 4389/78

[51] Int. Cl.[3] ..... B05D 7/00; B05D 3/02; C09D 5/16; C09D 5/18

[52] U.S. Cl. ..... 427/212; 106/18.14; 106/18.16; 106/18.17; 252/8.1; 427/325; 427/397; 428/403; 428/921; 264/109

[58] Field of Search ..... 427/212, 222, 317, 325, 427/397; 428/403, 921, 479; 106/18.14, 18.16, 18.17

[56] References Cited

U.S. PATENT DOCUMENTS

| | | | |
|---|---|---|---|
| 655,845 | 8/1900 | Winter | 427/212 |
| 1,571,048 | 1/1926 | Garrow | 427/212 |
| 2,817,617 | 12/1957 | Rogers | 427/212 X |
| 3,088,836 | 5/1963 | Garti et al. | 427/212 X |
| 3,840,388 | 10/1974 | Perlus et al. | 427/377 |
| 3,974,307 | 8/1976 | Bowen | 427/212 |

*Primary Examiner*—Michael R. Lusignan
*Attorney, Agent, or Firm*—Murray and Whisenhunt

[57] ABSTRACT

This specification describes a method for making a cellulosic material fire-resistant. The material is well dried and then impregnated with an aqueous solution containing phosphoric acid and ammonium sulphate and/or ammonium phosphate. The solution may also contain borax, trisodiumphosphate, ammonia, sodium carbonate, and sodium chloride. The method is particularly suited for treating sawdust in the manufacturing of chipboards. After impregnating the dry sawdust with the solution under stirring the material is dried once more and glue is applied whereupon chipboards are formed from the composite material.

15 Claims, No Drawings

METHOD FOR MAKING A CELLULOSIC MATERIAL FIRE-RESISTANT

The present invention relates to a method for making a cellulosic material fire-resistant, which means that the material will be fire-proof and practically non-burnable. More particularly the invention relates to a method in the manufacturing of cellulosic products, particularly chipboards, in order to make them fire-resistant in a very efficient but still economical way which readily may be brought to practice in existing plants and by existing apparatuses, e.g. in chipboard factories.

It is known since long that cellulosic materials can be made flame-resistant by impregnating with ammonium phosphate and ammonium sulphate. Thus it is disclosed already in the Swedish patent specification No. 8690 from year 1897 a method for making wood flame-resistant by impregnating with ammonium phosphate and ammonium sulphate. Among other patent specifications which also suggest impregnating with ammonium phosphate and ammonium sulphate in order to make cellulosic materials flame-resistant there should be mentioned the Swedish patent specification No. 176 928 and the U.S. Pat. No. 3,840,388.

According to the oldest of the said patent specifications, the Swedish patent specification No. 8690 from year 1897, the wood is first dried by heating in vacuum so that moisture is expelled, whereupon a solution of ammonium phosphate and ammonium sulphate is supplied. The development of the present art thereafter has turned to treating the cellulosic material in a wet condition with solutions which often contain ammonium phosphate and/or ammonium sulphate. Thus according to all the examples disclosed in the Swedish patent specification No. 176 928 from year 1961 the material is soaked in water or in an aqueous solution long enough to saturate the wood with moisture which is believed to open the wood and make it more receptive to the impregnating chemicals which are supplied to the wood after the wood has been saturated with moisture. The same principle is disclosed in the U.S. Pat. No. 3,840,388 from year 1974 stipulating that the cellulosic material (wood laminae) shall have a minimum moisture content of about 70 percent oven dry weight prior to immersing the material in a solution of fire-retarding agent.

The present invention deviates from these "modern" principles, which suggest soaking in water as a preparatory step in the process, therein that the material to the contrary preferably is well dried prior to impregnating with the fire-protective chemicals. The invention in this respect adopts the principles disclosed already in year 1897. The reason why these principles according to the invention can be revived in a manner which brings about an excellent fire-protection and which has considerable economical merits seems to be due to the fact that phosphoric acid is supplied to the well dried cellulosic material in combination with at least one ammonium salt, preferably ammonium sulphate and/or ammonium phosphate, in an aqueous solution. Additionally the solution also may contain one or more of the following agents, vix. borax, trisodiumphosphate, ammonia, sodium carbonate, and sodium chloride.

Prior to impregnation, the material is dried so that the whole of it, or so that portions of it (in reality those parts which will define outer layers in the finished products), will get a moisture content of maximum 10%, preferably maximum 5%, and suitably about 3%.

Thereafter the dried material is impregnated with the said aqueous solution which shall contain at least 2% phosphoric acid, and at least 1% ammonium sulphate which partly or completely may be replaced by one third quantity of ammonium phosphate (in the following called eq. quantity). The percentages here and elsewhere in this specification refer to weight-%. Preferably the aqueous solution contains at least 4% phosphoric acid and at least 2% ammonium sulphate which partly or completely may be replaced by an eq. quantity of ammonium phosphate. A preferred range for the phosphoric acid is 2–30%, suitably 4–15% and for the ammonium sulphate/eq. quantity of ammonium phosphate 1–10%, suitably 2–6%.

The invention further gives an opportunity for selective fire-protection of the material, at least at the preferred application of the invention, viz. manufacturing of fire-resistant chipboards. Those parts of the material which shall have highest fire-resistance—a priori those parts which shall define surface layers in the finished product—thus are impregnated with an aqueous solution containing at least 4% and suitably at least 6% phosphoric acid, and at least 1%, preferably at least 2% ammonium sulphate and/or eq. quantity of ammonium phosphate. From economical reasons impregnation of the inner portions of the material often can be comletely disregarded as the fire-resistance nevertheless in many cases is quite sufficient due to efficient protection of the surface layer. In most cases, however, the material is entirely impregnated or, as a possible compromise, are those parts which shall define the inner parts of the finished product, impregnated by a more diluted aqueous solution. For this diluted solution the above indicated limits may be halved by way of example.

Preferably the impregnation agent is adopted such that it obtains a pH between 5 and 7, suitably about 6, which also brings about a material with desired hardness.

In those cases when also other chemicals are used besides phosphoric acid and ammonium sulphate and/or ammonium phosphate in order further to improve the fire-resistance, the following quantities may be chosed:

0.5–5%, suitably 1–3% borax, $Na_2B_4O_7.10H_2O$

1–7%, suitably 1.5–5% trisodiumphosphate, $Na_3PO_4.12H_2O$ 0.5–4%, suitably 1–3% ammonia, $NH_3$ 0.3–2%, suitably 0.5–1.5% sodium carbonate, $Na_2CO_3$ 0.5–5%, suitably 1–3% sodium chloride, NaCl The principles of the invention may be applied for impregnating timber, sawn wood, veneer, e.g. veneer for plywood, wallboard and other wood fibre based products, but also for impregnating other cellulosic materials such as cotton and linen fabrics. In the first place, however, the invention has been designed for impregnation of sawdust and fine grain wood chips (in common called chips in this specification) in the production of chipboards in order to make them fire-resistant. According to this preferred embodiment of the invention the chips are first dried to the above indicated, low content of moisture, whereafterthey are intimately mixed with the aqueous solution containing phosporic acid and at least one ammonium salt, preferably ammonium sulphate and/or ammonium phosphate, so that a "pulp" is formed. This mixture should contain 35–70% aqueous solution, preferably 40–60% aqueous solution. Suitably the mixture contains approximately equal parts of dry substance and aqueous solution. In order to obtain an efficient treatment the mixture also preferably is mechanically stirred, e.g. in a vessel of the kind which is used for admixing of glue in the production of chipboards. When the aqueous solution has been absorbed thoroughly into the chips, these are again dried so that the majority of the moisture is expelled while the chemicals to an effective extent remain. Suitably the expel of moisture is run so far that the chips obtain substantially the same low content of moisture as prior to impregnation. Hereafter glue is supplied to the chips, whereupon chipboards are formed in a conventional way. Possibly only those chips which shall define the outer layers of the chipboards are treated according to the invention, while those chips which shall establish the inner part of the chipboards are not impregnated at all against fire or are only treated with a more diluted solution according to the alternative embodiment which has been described above.

EXAMPLE

Sawdust of the kind which is used for the production of chipboards was dried in heat to a moisture content of approximately 3%. For the treatment of this material there was prepared a solution having the following content:

0.3 Kg (2.5%) ammonium sulphate, $(NH_4)_2SO_4$
0.1 Kg (0.8%) ammonium phosphate, $NH_4H_2PO_4$
1.0 Kg (8.2%) phosphoric acid, $H_3PO_4$
0.2 Kg (1.6%) borax, $Na_2B_4O_7.10H_2O$
0.3 Kg (2.5%) trisodiumphosphate, $Na_3PO_4.12H_2O$
0.2 Kg (0.8%) sodium chloride, NaCl
10 Kg (82.0%) water, $H_2O$ 2.7 Kg of the dried chips (saw dust) were charged in a mixer and approximately 2.7 liters of the aqueous solution were sprayed over the saw dust. The mixture was well stirred to stimulate an even absorption of the liquid in the material. Thereafter the chips (saw dust) were once more dried in heat to a moisture content of about 3%. From this material there were made chipboard samples by the addition of glue to the impregnated and dried material and by pressing it in a way which is conventional in the production of chipboards. The samples turned out to have a very high fire-resistance, comparable to that of gypsum.

I claim:

1. A method of manufacturing fire-resistant wood-products comprising:

impregnating disintegrated wood material with an aqueous solution containing at least 2% phosphoric acid and 1–10% ammonium sulphate, which may be partly or completely replaced by a third as big quantity of ammonium phosphate, the quantity of said solution being 35–70% of the total weight of said solution plus wood material, drying the impregnated wood material to a maximum moisture content of 5% by weight, supplying glue to the impregnated, dried wood material, and forming wood-products of the combined impregnated wood material and glue.

2. Method of claim 1, wherein said solution contains 2–30% of phosphoric acid.

3. Method of claim 2, wherein the phosphoric acid content is at least 4%.

4. Method of claim 3, wherein the phosphoric acid content is 4–15%.

5. Method of claim 2, wherein said solution contains 2–6% of ammonium salts.

6. Method of any one of claims 1–5, wherein the disintegrated wood material is intimately mixed with the aqueous solution and mechanically stirred to stimulate an even absorption of the solution into the wood material.

7. Method of any one of claims 1–5, wherein said solution additionally contains at least one of the following ingredients:

0.5–5% borax
1–7% trisodium phosphate
0.5–5% ammonia
0.3–2% sodium carbonate
0.5–5% sodium chloride.

8. Method of claim 7, wherein said solution contains at least one of the following ingredients:

1–3% borax
1.5-5% trisodium phosphate
1–3% ammonia
0.5–1.5% sodium carbonate
1–3% sodium chloride.

9. Method of any one of claims 1–5, wherein said solution has a pH between 5 and 7.

10. Method of claim 9, wherein said pH is about 6.

11. Method for making wood sawdust and/or chips fire resistant, comprising drying said wood sawdust and/or chips to a moisture content of no greater than 10% by weight, thereafter impregnating the dried wood sawdust and/or chips with an aqueous solution containing at least 2% phosphoric acid and 1–10% of ammonium phosphate, which may be partly or completely replaced by a third as big quantity of ammonium phosphate, wherein the quantity of said aqueous solution is 35–70% by weight of the total weight of said aqueous solution plus said wood sawdust and/or chips, and thereafter the impregnated wood sawdust and/or chips are dried to a maximum moisture content of 10% by weight, to render said wood sawdust and/or chips fire-resistant.

12. Method of claim 11, wherein said wood sawdust and/or chips are initially dried to a moisture content of no greater than 5% by weight.

13. Method of claim 12, wherein said moisture content is about 3% by weight.

14. Method of claim 12, wherein said aqueous solution contains at least 4% by weight of phosphoric acid and at least 2% by weight of ammonium sulphate, or equivalent quantity of ammonium phosphate.

15. Method of any one of claims 11–14, wherein glue is supplied to the impregnated wood sawdust and/or chips, and the mixture of wood sawdust and/or chips and glue is formed into chipboards.

* * * * *

UNITED STATES PATENT AND TRADEMARK OFFICE

CERTIFICATE OF CORRECTION

PATENT NO. : 4,228,202

DATED : October 14, 1980

INVENTOR(S) : BO O. E. TJÄRNBERG

It is certified that error appears in the above-identified patent and that said Letters Patent are hereby corrected as shown below:

The correct name of the inventor is:

--Bo O. E. Tjärnberg-- and not "Bo O. E. Tjännberg"

Signed and Sealed this

*Twenty-fourth* Day of *March 1981*

[SEAL]

*Attest:*

RENE D. TEGTMEYER

*Attesting Officer*

*Acting Commissioner of Patents and Trademarks*